US010168064B1

(12) United States Patent
Zhang et al.

(10) Patent No.: US 10,168,064 B1
(45) Date of Patent: Jan. 1, 2019

(54) ULTRASONIC HUMIDIFIER

(71) Applicant: Zhongshan Titan Arts & Crafts Co., Ltd., Guangdong (CN)

(72) Inventors: Hong Ying Zhang, Guangdong (CN); Hui Li, Guangdong (CN); Feng Li, Guangdong (CN); Shao Quan Lu, Guangdong (CN)

(73) Assignee: Zhongshan Titan Arts & Crafts Co., Ltd., Guangdong (CN)

( * ) Notice: Subject to any disclaimer, the term of this patent is extended or adjusted under 35 U.S.C. 154(b) by 0 days.

(21) Appl. No.: 16/035,035

(22) Filed: Jul. 13, 2018

(51) Int. Cl.

| | |
|---|---|
| ***F24F 3/14*** | (2006.01) |
| ***B01F 3/04*** | (2006.01) |
| ***F24F 6/12*** | (2006.01) |
| ***B05B 17/06*** | (2006.01) |
| *F24F 6/00* | (2006.01) |

(52) U.S. Cl.
CPC ..... *F24F 6/12* (2013.01); *B01F 3/0407* (2013.01); *B05B 17/0607* (2013.01); *F24F 3/14* (2013.01); *F24F 2006/008* (2013.01)

(58) Field of Classification Search
CPC ..... F24F 3/14; B01F 3/04; B01F 3/04021; B01F 3/0407
USPC ..... 261/72.1, 81, DIG. 48
See application file for complete search history.

(56) References Cited

U.S. PATENT DOCUMENTS

| | | | | |
|---|---|---|---|---|
| 4,031,171 | A * | 6/1977 | Asao | B05B 17/0615 239/102.2 |
| 4,563,313 | A * | 1/1986 | Tsuaki | B05B 17/0615 261/81 |
| 4,921,639 | A * | 5/1990 | Chiu | F24F 6/12 137/256 |
| 8,777,187 | B2 | 7/2014 | Wong | |
| 9,360,227 | B2 | 6/2016 | Barker | |
| 2016/0146490 | A1 | 5/2016 | McDonnell et al. | |
| 2016/0356514 | A1 | 12/2016 | Cai et al. | |

* cited by examiner

*Primary Examiner* — Robert A Hopkins
(74) *Attorney, Agent, or Firm* — WPAT, P.C., Intellectual Property Attorneys; Anthony King

(57) ABSTRACT

An ultrasonic humidifier having stackable and detachable water reservoirs for easy expansion of its water storage capacity. A user can build the ultrasonic humidifier with a number of desired units of the stackable and detachable water reservoirs vertically to suit the usage and to accommodate the space in which the humidifier is used in. Each unit of the stackable and detachable water reservoirs has its own individual floater and draining device to control the replenishment of water to the unit it is attached to. The ultrasonic humidifier having stackable and detachable water reservoirs allows user to refill individual water reservoir unit separately.

20 Claims, 9 Drawing Sheets

*x-axis*: pre-determined water level in base chamber (height "h" in millimeter)
*y-axis*: mist output (ml/hr)
diameter of ultrasonic transducer plate: 25mm

ULTRASONIC HUMIDIFIER

FIELD OF THE DISCLOSURE

Various embodiments of the disclosure relate to a water misting device in general, and more specifically, to an ultrasonic humidifier with stackable and detachable water reservoirs for expanding water storage capacity of the humidifier.

BACKGROUND OF THE DISCLOSURE

Conventional humidifiers are common household electronic appliances to enhance the moisture content in the air. Existing humidifiers are mainly designed and confined to have a single water reservoir for the water supply of the appliance. When in need, for example, for larger space such as an office and a classroom, a humidifier having a larger water reservoir is required. However, a larger size humidifier often is heavy, bulky and takes up countertop space, it is often too heavy to refill water and causes spilling during the refill process.

Existing humidifiers such as the ones in U.S. Pat. No. 8,777,187 and U.S. PG-Pub 2016/0356514, both disclose having a water level controlling device connected to a draining device. In both disclosed humidifiers, the water supply/storage unit and its capacity is limited. Furthermore, the mist output unit is centrally positioned in which the water supply/storage unit surrounds and embraces the mist output unit.

One of the many disadvantages of the above-mentioned conventional and existing humidifiers includes the incapability to expand or adjust the water storage capacity due to their single water reservoir setup. And even if one attempts to enlarge the single water reservoir, another disadvantage arises; that is, due to the configuration of the water supply/storage unit and the mist output unit mentioned above, the conventional and existing humidifiers can be heavy, bulky and take up much of the countertop space, overall presenting undesirable design and nonpractical use.

Accordingly, it is thus an object of the present disclosure to provide a humidifier with stackable and detachable water reservoirs for an easy water refill mechanism as well as providing the capability for expanding its water storage capacity.

SUMMARY OF THE DISCLOSURE

The present disclosure relates to an ultrasonic humidifier having stackable and detachable water reservoirs to adjust the water storage capacity of the device. Each individual unit of the stackable and detachable water reservoirs has its separate floater and draining device.

Furthermore, the present disclosure is directed to a customized ultrasonic humidifier in which a user can utilize a number of stackable and detachable water reservoirs to build an ultrasonic humidifier with the desired water capacity.

One objective of the disclosure is to accomplish a space-saving design as each individual unit of the stackable and detachable water reservoirs of the ultrasonic humidifier has the same dimensions and is vertically stacked, thus achieving expansion of the water storage capacity without expanding the horizontal size of the device.

Another objective of the disclosure is to accomplish an easy-to-refill model where individual unit of the stackable and detachable water reservoirs can be detached, allowing user to refill individual unit separately without the need to carry one large and heavy water reservoir, thus preventing spillage during the refilling process. Given that, the individual unit of the stackable and detachable water reservoir also better fits into household sink making the refilling process an easier task.

Another objective of the disclosure is to accomplish lower manufacturing cost. That is, having the water reservoir configured into multiple stackable and detachable units, each unit having the same dimensions, a single molding can be used to manufacture the stackable and detachable water reservoir of the present disclosure. Compared to separately manufacturing water reservoirs with varies sizes as for conventional humidifiers, much of the manufacturing cost can be saved with the water reservoir design of the present disclosure.

One embodiment of the disclosure relates to an ultrasonic humidifier having a base chamber coupled to a water reservoir, and the water reservoir is coupled to a water tank. The base chamber and the water reservoir each comprises a floater, and the floater in the water reservoir is positioned at an upper portion of the water reservoir.

In another embodiment, an ultrasonic humidifier includes a base chamber, a first reservoir, a second reservoir and a top water tank. Each of the base chamber, the first reservoir and the second reservoir has its respective floater.

In another embodiment, an ultrasonic humidifier includes a base chamber coupled to a plurality of stackable water reservoirs, the plurality of stackable water reservoirs is vertically stacked on the base chamber, and a top water tank is disposed on top of the plurality of the stackable water reservoirs. In one aspect of the embodiment, the dimensions of each of the plurality of stackable water reservoirs are identical.

In yet another embodiment, an ultrasonic humidifier includes a base chamber, a stackable and detachable water reservoir and a mist channel. In one aspect of the embodiment, the stackable and detachable water reservoir is directly disposed on top of the base chamber with the mist channel disposed alongside the water reservoir and the base chamber without interfering the water flow from the water reservoir into the base chamber.

Various objects, features, aspects and advantages of the present disclosure will become more apparent from the following detailed description of embodiments of the disclosure, along with the accompanying drawings in which like numerals represent like components.

BRIEF DESCRIPTION OF THE DRAWINGS

The accompanying drawings, which are incorporated in and constitute a part of this specification, illustrate several aspects described below.

DETAILED DESCRIPTION OF THE PREFERRED EMBODIMENTS

It is to be understood that this disclosure is not limited to particular embodiments described, as such may, of course, vary. The terminology used herein is for the purpose of describing particular embodiments only, and is not intended to be limiting, since the scope of this disclosure will be limited only by the appended claims. It is expressly understood that the disclosure as defined by the claims may be broader than the illustrated embodiments described below. It should be noted that the drawings are in simplified form and are not to precise scale. It should further be noted that as used herein and in the appended claims, the singular forms "a", "an", and "the" include plural referents unless the context clearly dictates otherwise.

The words used in this specification to describe the disclosure and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The contents of all reference(s), patent(s), and patent application publication(s) cited in this application are hereby incorporated by reference in their entireties.

Figure 1:
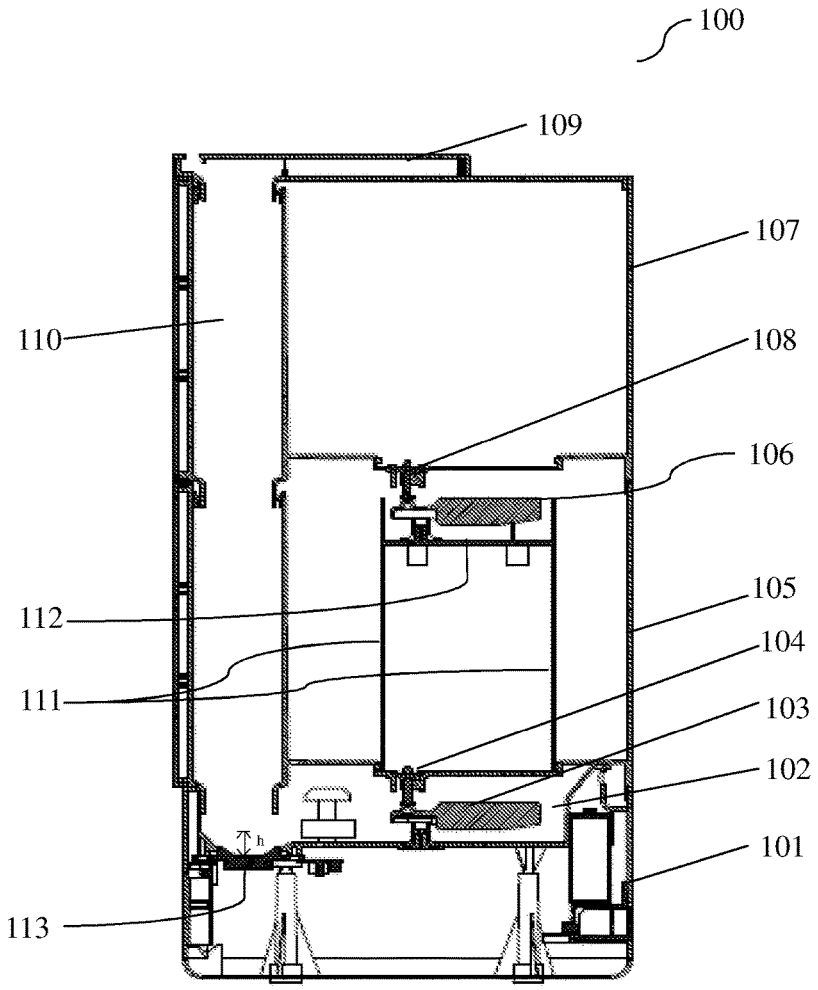
FIG. 1 is a cross-sectional perspective view of an ultrasonic humidifier according to an embodiment of the present disclosure.

FIG. 1 illustrates an embodiment of the present disclosure showing an ultrasonic humidifier 100 having a base 101 and a base chamber 102, the base chamber 102 is disposed within the base 101. Provided in the base chamber 102 is a floater 103, the floater 103 is positioned to connect to a draining device 104 for draining water from a water reservoir 105. The water reservoir 105 is coupled to the base chamber 102. In the water reservoir 105, another floater 106 is positioned at an upper portion of the water reservoir 105. The upper portion of the water reservoir 105 is the top half of the water reservoir 105 proximal to a top water tank 107, a lower portion of the water reservoir 105 is the bottom half of the water reservoir 105 proximal to the base chamber 102. The top half and the bottom half of the water reservoir 105 are divided by the midline of the water reservoir 105. Another draining device 108 is coupled to the top water tank 107. The top water tank 107 is disposed on top of the water reservoir 105 and is covered by a top cover 109.

The draining device 104 is disposed on the bottom surface of the water reservoir 105 and its body extends from the water reservoir 105 to the base chamber 102 to couple with the floater 103. The draining device 108 is disposed on the bottom surface of the top water tank 107 and its body extends from the top water tank 107 to the water reservoir 105 to couple with the floater 106.

As shown in FIG. 1, a mist channel 110 is vertically disposed alongside the water reservoir 105 and the top water tank 107. The mist channel 110 is extended from the base chamber 102. That is, one end of the mist channel 110 is connected to the base chamber 102 and the other end of the mist channel 110 is exposed to an open space or partially covered by the top cover 109.

Also shown in FIG. 1 is a pair of permeable brackets 111 extends from the bottom surface of the water reservoir 105 which provides a platform 112 to keep the floater 106 in position at the upper portion of the water reservoir 105. The pair of permeable brackets 111 stands perpendicularly with respect to the bottom surface of the water reservoir 105, the platform 112 is provided in between the pair of permeable brackets 111 where the floater 106 is situated. The pair of permeable brackets 111 and the platform 112 are perpendicular to each other; each end of the platform 112 is directly connected to one of the pair of permeable brackets 111 forming a right angle at 90 degree (90°). The platform 112 couples to the floater 106 and provides stability for the floater 106. The platform is positioned proximal to the draining device 108 as the floater 106 is coupled to the draining device 108.

The pair of permeable brackets 111 and the platform 112 can be made of permeable material, contemplated permeable material includes, but not limited to, thermoplastic resin such as polypropylene and acrylonitrile butadiene styrene. The permeability of the pair of permeable brackets 111 and the platform 112 allows water to pass through. Another contemplated feature is having open pores or open slits on the pair of permeable brackets 111 and the platform 112 to allow water to pass through.

The floater 103 and the floater 106 can be made of material with density less than the density of water thus capable of maintaining in a floating position. The contemplated material includes, but not limited to, polystyrene foam, plastic and wood, and can also be a mixture of any material with floating property having density less than the density of water. The floater 103 and the floater 106 have an elongated shape. When the floater 103 and the floater 106 are in their upright (horizontal) position resting on the surface of water, the longitudinal axis of the floater 103 is parallel to the bottom surface of the base chamber 102 and the longitudinal axis of the floater 106 is parallel to the bottom surface of the water reservoir 105. The elongated shape of the floater 103, 106 allows sufficient contacting surface between the floater 103, 106 and water, necessary for detecting the water level in the base chamber and the water reservoir, respectively.

As mentioned and shown in FIG. 1, the draining device 104 is disposed on the bottom surface of the water reservoir 105 and the draining device 108 is disposed on the bottom surface of the top water tank 107. Each of the draining device 104, 108 comprises an engaging valve coupled to an elongated member. During operation, the engaging valve of the draining device 104, 108 moves up and down to control the flow of the water from one compartment to another.

In one aspect of the inventive subject matter, when the water level in the base chamber 102 falls and fails to keep the floater 103 in a horizontal position (parallel to the plane of the horizon), the floater 103 moves with the water level and tilts downward towards the bottom surface of the base chamber 102. With the floater 103 tilting downward, the elongated member of the draining device 104, which is in contact with the floater 103, moves upward and pushes the engaging valve of the draining device 104 to move upward, thus opening an outlet allowing water from the water reservoir 105 to enter the base chamber 102 and replenishes the water in the base chamber 102 until the water in the base chamber 102 reaches a pre-determined water level in which the floater 103 moves back upward to remains at the horizontal position.

In one or more embodiments, the floater 103 rests on the surface of the water in the base chamber 102, the pre-determined water level in the base chamber 102 is the water level which keeps the floater 103 in the horizontal position.

The pre-determined water level has a height "h". The height "h" is measured from the exposing surface of an ultrasonic transducer plate 113 to the bottom rim of the floater 103, the bottom rim of the floater 103 is the bottom surface/edge of the floater 103 that is in contact with the surface of the water in the base chamber 102. The ultrasonic transducer plate 113 is disposed adjacent to the base chamber 102 and is connected to the bottom surface of the base chamber 102 and directly under the mist channel 110.

Figure 9:
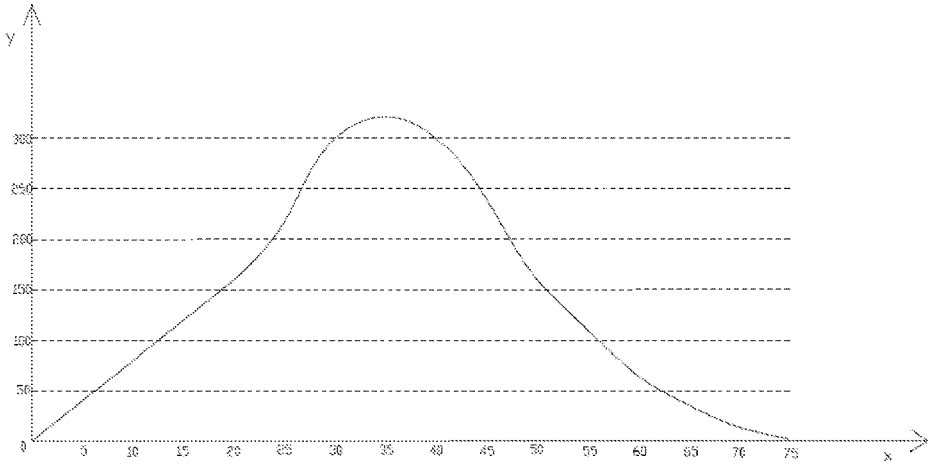
FIG. 9 is graph of the present disclosure showing mist output with respect to the water level in the base chamber.

Provide in FIG. 9 is a graph showing mist output with respect to the water level in the base chamber; more specifically, the pre-determined water level in the base chamber 102. In some embodiments, the height "h" ranges from 10 mm (millimeter) to 55 mm, an alternative range is from 20 mm to 50 mm, yet another alternative range is from 25 mm to 45 mm, and a preferred range is from 30 mm to 40 mm. In a preferred embodiment, the height "h" is approximately at 35 mm for optimal mist output; when the height "h" is at 35 mm, the mist output is over 300 ml/hr (milliliter per hour).

Furthermore, when the water level in the water reservoir 105 falls and fails to keep the floater 106 in a horizontal position (the floater 106 in a horizontal position means when the elongated body of the floater 106 is parallel to the bottom surface of the water reservoir 105), the floater 106 moves with the water level and tilts downward toward the bottom surface of the water reservoir 105. With the floater 106 tilting downward, the elongated member of the draining device 108, which is in contact with the floater 106, moves upward and pushes the engaging valve of the draining device 108 to move upward, thus opening an outlet allowing water from the top water tank 107 to enter the water reservoir 105 and replenishes the water in the water reservoir 105 until the water level in the water reservoir 105 reaches and returns to keep the floater 106 back to the horizontal position.

In another aspect of the inventive subject matter, the floater 103 in the base chamber 102 vertically aligns with the floater 106 in the water reservoir 105 as shown in FIG. 1. Vertical alignment of the floater 103 and the floater 106 means the floater 103 is spatially positioned directly below the floater 106.

In another aspect of the inventive subject matter, the floater 103 and the floater 106 are both perpendicular to the plane of the horizon.

In yet another aspect of the inventive subject matter, the draining device 104 located at the bottom surface of the water reservoir 105 vertically aligns with the draining device 108 located at the bottom surface of the top water tank 107 as shown in FIG. 1. Vertical alignment of the draining device 104 and the draining device 108 means the draining device 104 is spatially positioned directly below the draining device 108.

In another aspect of the inventive subject matter, the draining device 104 and the draining device 108 are both perpendicular to the plane of the horizon.

In yet another aspect of the inventive subject matter, a reed switch is disposed in the base chamber 102, when the water supply in the base chamber 102, the water reservoir 105 and the top water tank 107 are depleted, the reed switch functions to shut off the power of the ultrasonic humidifier 100.

Figure 2:
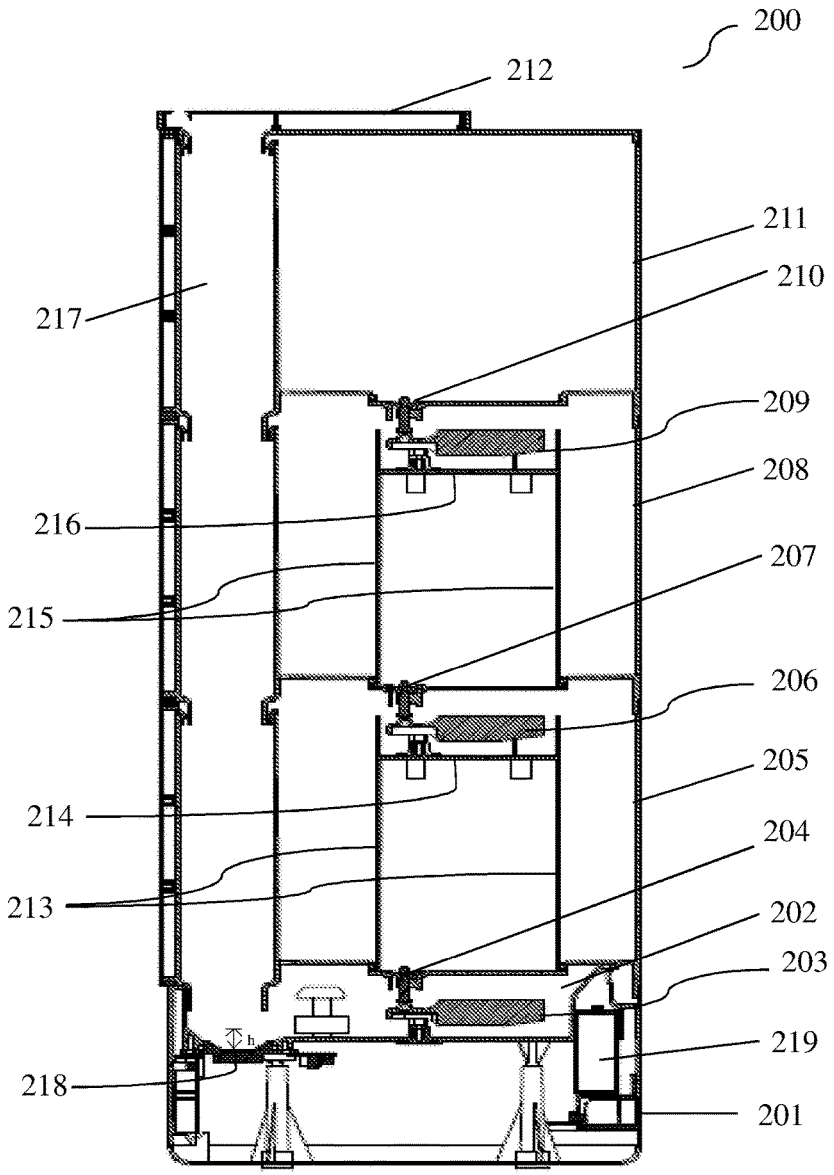
FIG. 2 is a cross-sectional perspective view of an ultrasonic humidifier according to another embodiment of the present disclosure showing at least one water reservoir disposed between the base chamber and the top water tank according to one embodiment of the present disclosure.

Referring now to FIG. 2. FIG. 2 illustrates an embodiment of the present disclosure showing an ultrasonic humidifier 200 having a base 201, a base chamber 202, a first reservoir 205, a second reservoir 208 and a top water tank 211.

The base chamber 202 is located in the base 201. Provided in the base chamber 202 is a first floater 203, the first floater 203 is positioned to connect to a first draining device 204 for draining water from the first reservoir 205. The first reservoir 205 is disposed on top of the base chamber 202.

In the first reservoir 205, a second floater 206 is positioned at an upper portion of the first reservoir 205. The upper portion of the first reservoir 205 is the top half of the first reservoir 205 proximal to the second reservoir 208, a lower portion of the first reservoir 205 is the bottom half of the first reservoir 205 proximal to the base chamber 202. The top half and the bottom half of the first reservoir 205 are divided by the midline of the first reservoir 205. The second reservoir 208 is disposed on top of the first reservoir 205.

In the second reservoir 208, a third floater 209 is positioned at an upper portion of the second reservoir 208. The upper portion of the second reservoir 208 is the top half of the second reservoir 208 proximal to the top water tank 211, a lower portion of the second reservoir 208 is the bottom half of the second reservoir 208 proximal to the first reservoir 205. The top half and the bottom half of the second reservoir 208 are divided by the midline of the second reservoir 208. The top water tank is disposed on top of the second reservoir 208 and is covered by a top cover 212.

In FIG. 2, the first draining device 204 is disposed on the bottom surface of the first reservoir 205 and its body extends from the first reservoir 205 to the base chamber 202 to couple with the first floater 203. The second draining device 207 is disposed on the bottom surface of the second reservoir 208 and its body extends from the second reservoir 208 to the first reservoir 205 to couple with the second floater 206. The third draining device 210 is disposed on the bottom surface of the top water tank 211 and its body extends from the top water tank 211 to the second reservoir 208 to couple with the third floater 209.

Also shown in FIG. 2 is a pair of permeable brackets 213 extends from the bottom surface of the first reservoir 205 providing a platform 214 to keep the second floater 206 in position at the upper portion of the first reservoir 205. The pair of permeable brackets 213 stands perpendicularly with respect to the bottom surface of the first reservoir 205, the platform 214 is provided in between the pair of permeable brackets 213 where the second floater 206 is situated. The platform 214 couples to the second floater 206 and provides stability for the second floater 206. The platform is positioned proximal to the second draining device 207 as the second floater 206 is coupled to the second draining device 207.

Moreover, a pair of permeable brackets 215 extends from the bottom surface of the second reservoir 208 providing a platform 216 to keep the third floater 209 in position at the upper portion of the second reservoir 208. The pair of permeable brackets 215 stands perpendicularly with respect to the bottom surface of the second reservoir 208, the platform 216 is provided in between the pair of permeable brackets 215 where the third floater 209 is situated. The platform 216 couples to the third floater 209 and provides stability for the third floater 209. The platform is positioned proximal to the top water tank 211 as the third floater 209 is coupled to the third draining device 210.

As provided, the pair of permeable brackets 213 and the platform 214 are perpendicular to each other; each end of the platform 214 is directly connected to one of the pair of permeable brackets 213 forming a right angle at 90 degree (90°). The pair of permeable brackets 215 and the platform 216 are perpendicular to each other; each end of the platform 216 is directly connected to one of the pair of permeable brackets 215 forming a right angle at 90 degree (90°). The pair of permeable brackets 213 and the pair of permeable brackets 215 vertically aligns with each other and the platform 214 and the platform 216 are parallel to each other.

In the present contemplated embodiment, the pair of permeable brackets 213, 215 and the platform 214, 216 can be made of permeable material as mentioned above (material mentioned in the embodiment provided above). The permeability of the pair of permeable brackets 213, 215 and the platform 214, 216 allow water to pass through. Furthermore, the first floater 203, the second floater 206 and the third floater 209 in this contemplated embodiment can be made of material with density less than the density of water as mentioned above (material mentioned in the embodiment provided above).

Also shown in FIG. 2, the first draining device 204 is disposed on the bottom surface of the first reservoir 205, the second draining device 207 is disposed on the bottom surface of the second reservoir 208, and the third draining device 210 is disposed on the bottom surface of the top water tank 211. As described in the previously provided embodiment, each draining device 204, 207, 210 comprises an engaging valve coupled to an elongated member. During operation, the engaging valve of the draining device moves up and down to control the flow of the water from one compartment to another.

In one aspect of the inventive subject matter, when the water level in the base chamber 202 falls and fails to keep the first floater 203 in a horizontal position, the first floater 203 moves with the water level of the base chamber 202 and tilts downward toward the bottom surface of the base chamber 202. With the first floater 203 tilting downward, the elongated member of the first draining device 204, which is in contact with the first floater 203, moves upward and pushes the engaging valve of the first draining device 204 to move upward, thus opening an outlet allowing water from the first reservoir 205 to enter the base chamber 202 and replenishes the water in the base chamber 202 until the water in the base chamber 202 reaches a pre-determined water level in which the first floater 203 moves back upward to remains at the horizontal position.

The same mechanism applies to the second floater 206 and the second draining device 207 between the first reservoir 205 and the second reservoir 208. That is, when the water level in the first reservoir 205 falls and fails to keep the second floater 206 in a horizontal position, the second floater 206 moves with the water level of the first reservoir 205 and tilts downward toward the bottom surface of the first reservoir 205. With the second floater 206 tilting downward, the elongated member of the second draining device 207, which is in contact with the second floater 206, moves upward and pushes the engaging valve of the second draining device 207 to move upward, thus opening an outlet allowing water from the second reservoir 208 to enter the first reservoir 205 and replenishes the water in the first reservoir 205 until the water in the first reservoir 205 reaches a pre-determined water level in which the second floater 206 moves back upward to remains at the horizontal position.

Moreover, the same mechanism applies to the third floater 209 and the third draining device 210 between the second reservoir 208 and the top water tank 211. That is, when the water level in the second reservoir 208 falls and fails to keep the third floater 209 in a horizontal position, the third floater 209 moves with the water level of the second reservoir 208 and tilts downward toward the bottom surface of the second reservoir 208. With the third floater 209 tilting downward, the elongated member of the third draining device 210, which is in contact with the third floater 209, moves upward and pushes the engaging valve of the third draining device 210 to move upward, thus opening an outlet allowing water from the top water tank 211 to enter the second reservoir 208 and replenishes the water in the second reservoir 208 until the water in the second reservoir 208 reaches a pre-determined water level in which the third floater 209 moves back upward to remains at the horizontal position.

In one aspect of the inventive subject matter, the first floater 203 rests on the surface of the water in the base chamber 202, the pre-determined water level in the base chamber 202 is the water level which keeps the first floater 203 in the horizontal position.

The pre-determined water level has a height "h". The height "h" is measured from the exposing surface of an ultrasonic transducer plate 218 to the bottom rim of the first floater 203, the bottom rim of the first floater 203 is the bottom surface/edge of the first floater 203 that is in contact with the surface of the water in the base chamber 202. The ultrasonic transducer plate 218 is disposed adjacent to the base chamber 202 and is connected to the bottom surface of the base chamber 202 and directly under a mist channel 217.

As mentioned above and provide in FIG. 9, a graph shows mist output with respect to the water level in the base chamber. In some embodiments, the height "h" ranges from 10 mm to 55 mm, an alternative range is from 20 mm to 50 mm, yet another alternative range is from 25 mm to 45 mm, and a preferred range is from 30 mm to 40 mm. In a preferred embodiment, the height "h" is approximately at 35 mm for optimal mist output; when the height "h" is at 35 mm, the mist output is over 300 ml/hr.

Overall in the present contemplated embodiment, when the water level in the base chamber 202 falls lower than the pre-determined water level defined above, the first reservoir 205 replenishes the water in the base chamber 202 via the first draining device 204 (mechanism described above). Subsequently, the first reservoir 205 is replenished by the water in the second reservoir 208, and the second reservoir 208 is replenished by the water in the top water tank 211.

In one aspect of the inventive subject matter, a reed switch is disposed in the base chamber 202, when the water supply in the base chamber 202, the first reservoir 205, the second reservoir 208 and the top water tank 211 are depleted, the reed switch functions to shut off the power of the ultrasonic humidifier 200.

In another aspect of the inventive subject matter, each of the first floater 203, the second floater 206 and the third floater 209 vertically aligns with one another as shown in FIG. 2. Vertical alignment of the first floater 203, the second floater 206 and the third floater 209 means they are spatially positioned directly above and below each other.

In another aspect of the inventive subject matter, the first floater 203, the second floater 206 and the third floater 209 are all perpendicular to the plane of the horizon.

In yet another aspect of the inventive subject matter, each of the first draining device 204, the second draining device 207 and the third draining device 210 vertically aligns with one another as shown in FIG. 2. Vertical alignment of the first draining device 204, the second draining device 207 and the third draining device 210 means they are spatially positioned directly above and below each other.

In another aspect of the inventive subject matter, the first draining device 204, the second draining device 207 and the third draining device 210 are all perpendicular to the plane of the horizon.

Furthermore, the mist channel 217 is vertically disposed alongside the first reservoir 205, the second reservoir 208 and the top water tank 211. The mist channel 217 is extended from the base chamber 202. That is, one end of the mist channel 217 is connected to the base chamber 202 and the other end of the mist channel 217 is exposed to an open space or partially covered by the top cover 212. One aspect of a contemplated embodiment, the longitudinal axis of the mist channel 217 is perpendicular to the plane of the horizon.

In another aspect of the inventive subject matter, the ultrasonic transducer plate 218 is disposed in the base 201 on one side of the base chamber 202 and a fan 219 is disposed in the base 201 on another side of the base chamber 202 as shown in FIG. 2. That is, the ultrasonic transducer plate 218 is positioned on one side of the first floater 203 and the fan 219 is position on the other side of the first floater 203 opposite to the ultrasonic transducer plate 218. The ultrasonic transducer plate 218 is situated adjacent to the base chamber 202 and directly below the mist channel 217.

In another aspect of the inventive subject matter, the first reservoir 205, the second reservoir 208 and the top water tank 211 have the same geometric shape. The geometric shape of the first reservoir 205, the second reservoir 208 and the top water tank 211 includes, but not limited to, a cube, a cuboid, a cylinder, a regular polygonal prism such as a pentagonal prism and a hexagonal prism and an irregular polygonal prism.

In yet another aspect of the inventive subject matter, the first reservoir 205 and the second reservoir 208 have identical dimensions. In one embodiment, the dimensions of the first reservoir 205 and the second reservoir 208 are defined by the same length, the same width and the same height.

In another embodiment, the first reservoir 205 and the second reservoir 208 have identical dimensions, the dimensions of the first reservoir 205 and the second reservoir 208 are defined by the diameter/radius and height of their cylindrical shapes. In one embodiment, the first reservoir 205 and the second reservoir 208 have the same diameter/radius and the same height.

In another contemplated embodiment, the top water tank 211 have the same dimensions as the first reservoir 205 and the second reservoir 208.

In another contemplated embodiment, the top water tank 211 has different dimensions; the top water tank 211 may have a greater height than the first reservoir 205 and the second reservoir 208 to accommodate more water storage thus minimizing the frequency to refill, it may also have a shorter height than the first reservoir 205 and the second reservoir 208 to allow easier refill as smaller water tank is lighter to carry and better fits in a household sink. That is, the top water tank 211 may be any desired size suitable for a user's need and the space allowed.

Figure 5:
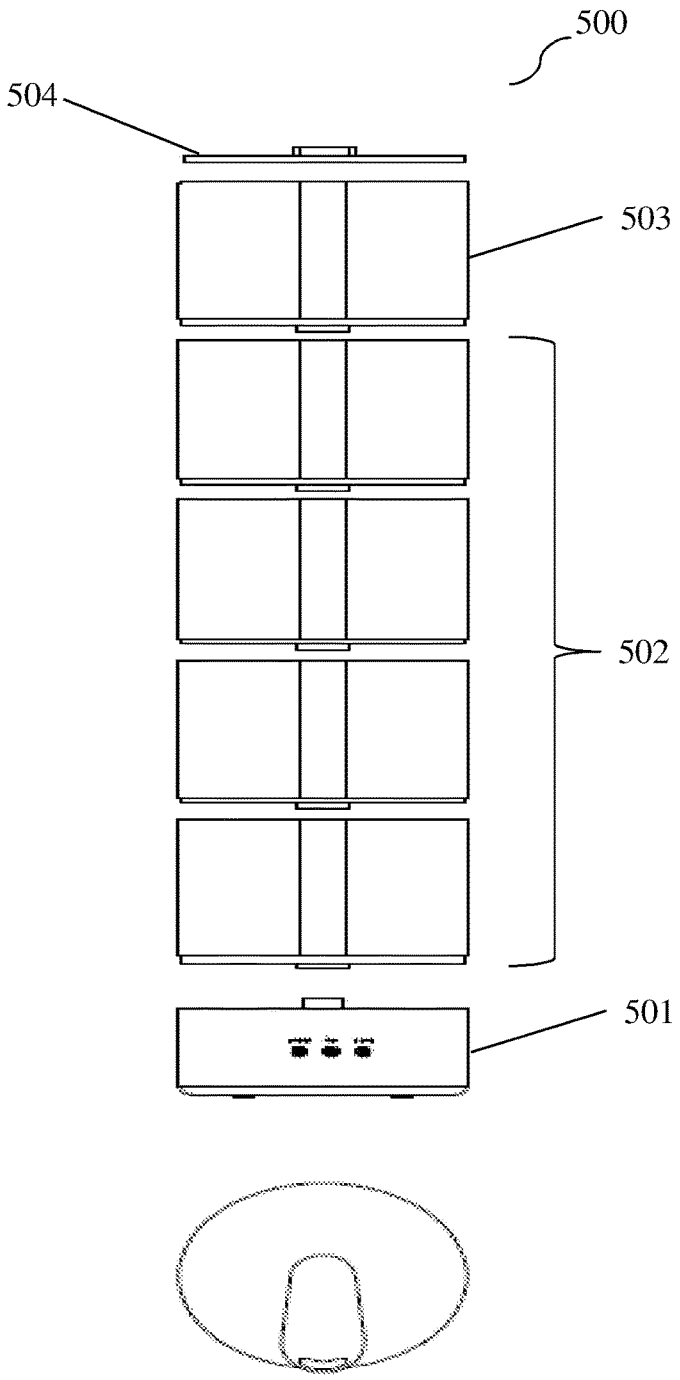
FIG. 5 is a side perspective view of an ultrasonic humidifier illustrating a plurality of stackable and detachable water reservoirs according to an embodiment of the present disclosure.

In one embodiment, as shown in FIG. 5, an ultrasonic humidifier 500 has a plurality of stackable water reservoirs 502, the plurality of stackable water reservoirs 502 is in cylindrical shape and all units of the plurality of stackable water reservoirs 502 have identical dimensions. The diameter/radius and height of each of the plurality of stackable water reservoirs 502 are the same with each other.

In FIG. 5, the plurality of stackable water reservoirs 502 is disposed between a base 501 and a top water tank 503 and is covered by a top cover 504. The top water tank 503 is disposed directly on top of an uppermost unit of the plurality of stackable water reservoirs 502.

The elements within the base 501 include a base chamber, a floater, a fan and a ultrasonic transducer plate. These mentioned elements in the base 501 have the same functions and are structurally configured the same way as mentioned in the previous embodiments.

The elements within each unit of the plurality of stackable water reservoirs 502 include a floater, a draining device, a pair of brackets and a platform. These mentioned elements in each unit of the plurality of stackable water reservoirs 502 have the same functions and are structurally configured the same way as mentioned in the previous embodiments.

Overall, in the ultrasonic humidifier 500, the top water tank 503 supplies water to the plurality of stackable water reservoirs 502, and the plurality of stackable water reservoirs 502 supplies water to the base chamber located in the base 501. A mist channel extended from the base chamber is vertically disposed alongside the plurality of stackable water reservoirs 503 and the top water tank 503 and outputs mist via a slit opening of the top cover 504.

The number of units of the plurality of stackable water reservoirs 502 is not limited, a user can easily add more units by vertically stacking additional water reservoirs and can easily remove units by detaching the water reservoirs. Each unit of the plurality of stackable water reservoirs 502 has identical dimensions thus making it easy for stacking and detaching the water reservoirs; each unit of the plurality of stackable water reservoirs 502 has complementary edges and grooves that can be fitted and pressed onto each other for stacking and pulled apart to disengage for detaching. By adding additional units of the plurality of stackable water reservoirs 502, the overall water capacity of the ultrasonic humidifier 500 is increased, and by removing at least one of the plurality of stackable water reservoirs 502, the overall water capacity of the ultrasonic humidifier 500 is reduced accordingly.

Figure 6:
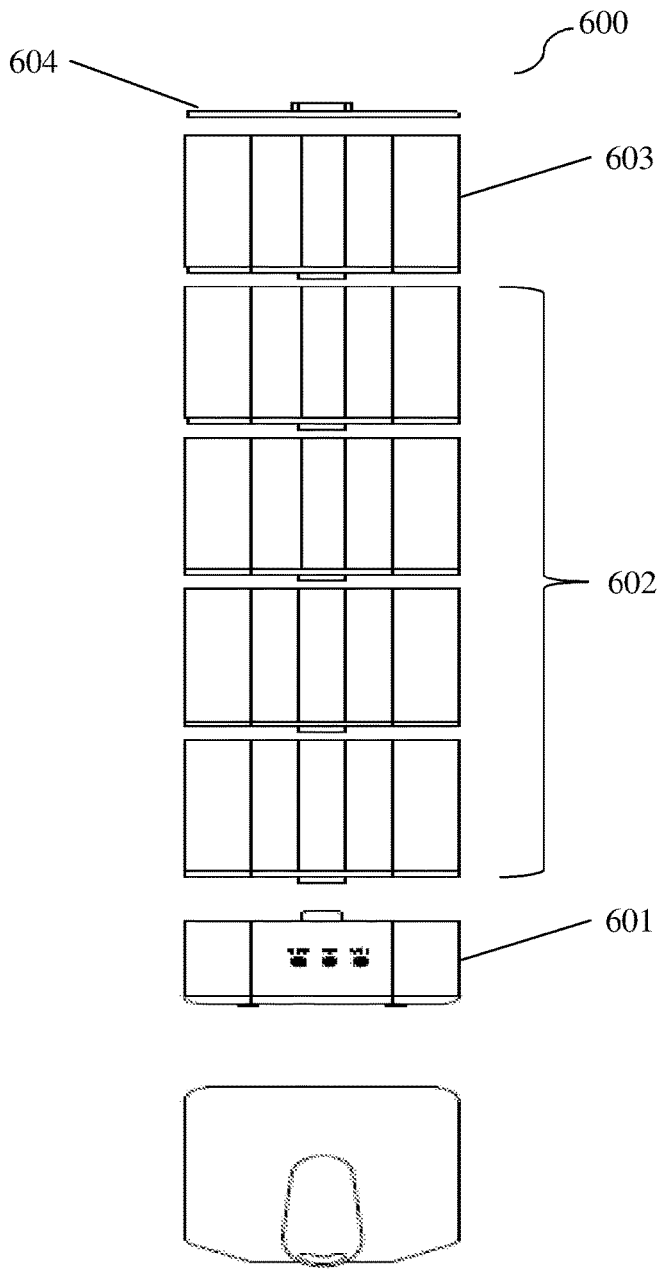
FIG. 6 is a side perspective view of an ultrasonic humidifier illustrating a plurality of stackable and detachable water reservoirs according to another embodiment of the present disclosure.

In another exemplary embodiment, an ultrasonic humidifier 600 as illustrated in FIG. 6 has an irregular polygonal prism shape. The ultrasonic humidifier 600 includes a plurality of stackable water reservoirs 602 disposed between a base 601 and a top water tank 603 and is covered by a top cover 604. The top water tank 603 is disposed directly on top of an uppermost unit of the plurality of stackable water reservoirs 602.

The ultrasonic humidifier 600 in FIG. 6 is a design variant of the ultrasonic humidifier 500 in FIG. 5 described above with all elements being functioned and structurally configured the same. It is noted that the external form of the ultrasonic humidifier is not limited to any specific shape, FIG. 5 and FIG. 6 are exemplary embodiments for illustrations.

The exemplary embodiments as shown in FIG. 5 and FIG. 6 are not intended to limit the number of units of the plurality of stackable water reservoirs 502, 602. FIG. 5 and FIG. 6 illustrate the vertical connectivity of the plurality of water reservoirs 502, 602 with one another, as well as the water reservoirs' connectivity with respect to the base 501, 601 and the top water tank 503, 603. Depending on a user's need and the space allowed, a desired number of unit of the plurality of stackable water reservoirs 502, 602 may be utilized.

Figure 3:
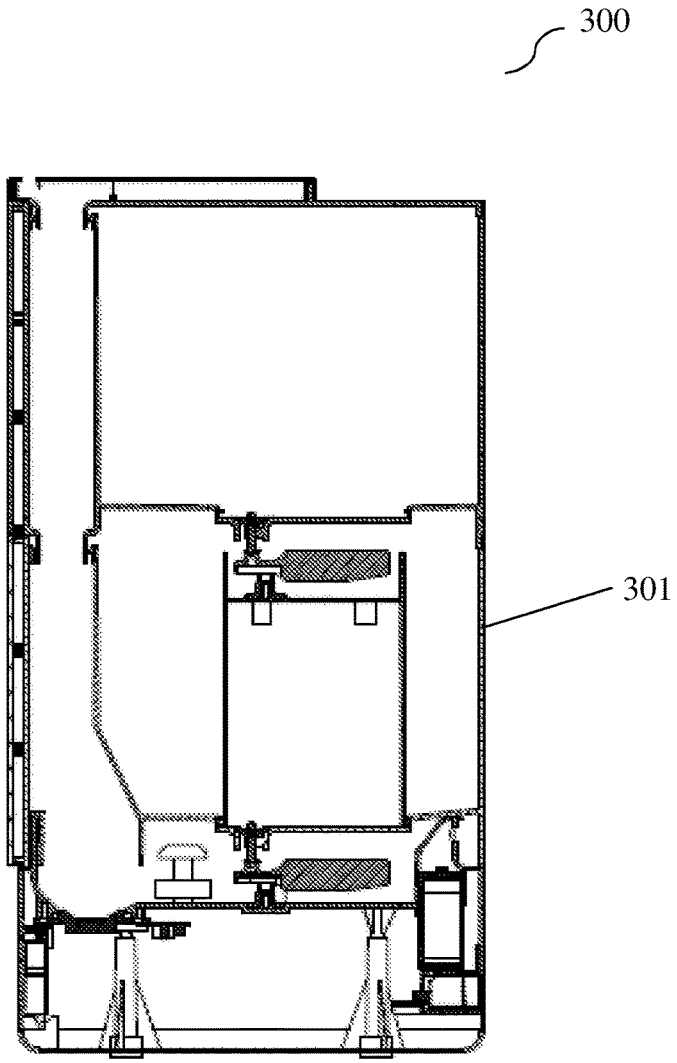
FIG. 3 is a cross-sectional perspective view of an ultrasonic humidifier according to another embodiment of the present disclosure.
Figure 4:
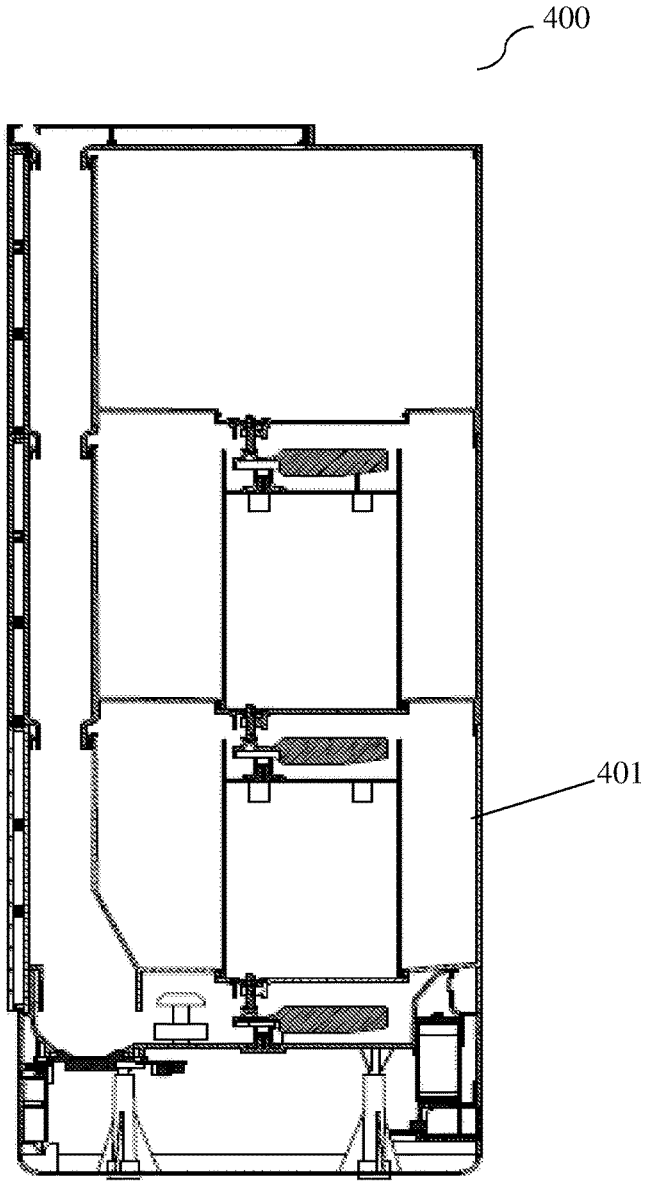
FIG. 4 is a cross-sectional perspective view of an ultrasonic humidifier according to another embodiment of the present disclosure.

Referring to FIG. 3 and FIG. 4, FIG. 3 and FIG. 4 depict an ultrasonic humidifier 300 and an ultrasonic humidifier 400, respectively. The ultrasonic humidifier 300 and the ultrasonic humidifier 400 are variants of the ultrasonic humidifiers shown in FIG. 1 and FIG. 2. It is provided that their respective first reservoirs 301 and 401 have slight design modification to facilitate the water draining and mist outputting processes.

Figure 7:
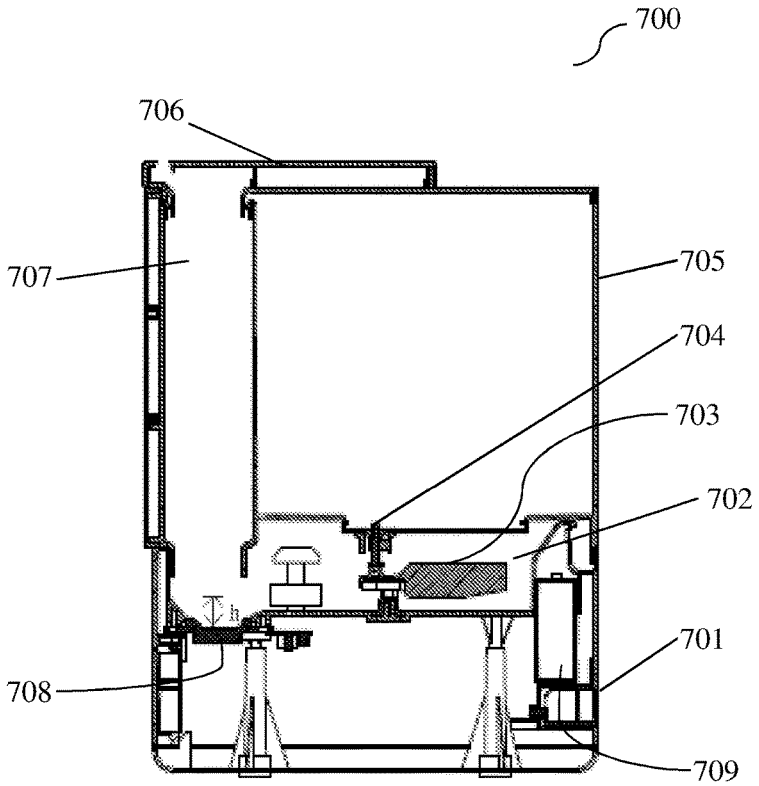
FIG. 7 is a cross-sectional perspective view of an ultrasonic humidifier according to another embodiment of the present disclosure.

Another exemplary embodiment shown in FIG. 7 illustrates a contemplated model of an ultrasonic humidifier 700 having a base 701 and a base chamber 702, in which the base chamber 702 is disposed within the base 701. Provided in the base chamber 702 is a floater 703 and the floater 703 is positioned to connect to a draining device 704 for draining water from a water reservoir 705. The water reservoir 705 is coupled to the base chamber 702; the water reservoir 705 can be stacked onto and detached from the base chamber 702 to easily refill the water supply of the ultrasonic humidifier 700.

The draining device 704 is disposed on the bottom surface of the water reservoir 705 and its body extends from the water reservoir 705 to the base chamber 702 to couple with the floater 703. A mist channel 707 is vertically disposed alongside the water reservoir 705. The mist channel 707 is extended from the base chamber 702 as one end of the mist channel 707 is connected to the base chamber 702 and the other end of the mist channel 707 is exposed to an open space or partially covered by a top cover 706.

With water in the base chamber 702 being supplied from the water reservoir 705, a pre-determined water level is kept in the base chamber 702. The pre-determined water level in the base chamber 702 is the water level which keeps the floater 703 in the horizontal position as the floater 703 rests on the surface of the water in the base chamber 702. The pre-determined water level has a height "h". The height "h" is measured from the exposing surface of an ultrasonic transducer plate 708 to the bottom rim of the floater 703, the bottom rim of the floater 703 is the bottom surface/edge of the floater 703 that is in contact with the surface of the water in the base chamber 702. The ultrasonic transducer plate 708 is disposed adjacent to the base chamber 702 and is connected to the bottom surface of the base chamber 702 and directly under the mist channel 707.

As shown in FIG. 7, the ultrasonic transducer plate 708 is disposed in the base 701 on one side of the base chamber 702 and a fan 709 is disposed in the base 701 on another side of the base chamber 702.

In one aspect of the inventive subject matter, the water reservoir 705 is directly disposed on top of the base chamber 702 as these two compartments vertically aligned with each other, and the mist channel 707 is vertically disposed alongside the base chamber 702 and the water reservoir 705. That is, structurally, the location of the mist channel 707 does not interfere with the configuration of the water reservoir 705 and the base chamber 702, meaning that the mist channel 707 does not interfere the flow of the water from the water reservoir 705 to the base chamber 702 (the mist channel 707 is position on one side of the ultrasonic humidifier 700 as opposed to having the mist channel embraced within the water reservoir). The mist being outputted exit via the mist channel 707 on one side of the ultrasonic humidifier 700.

Figure 8:
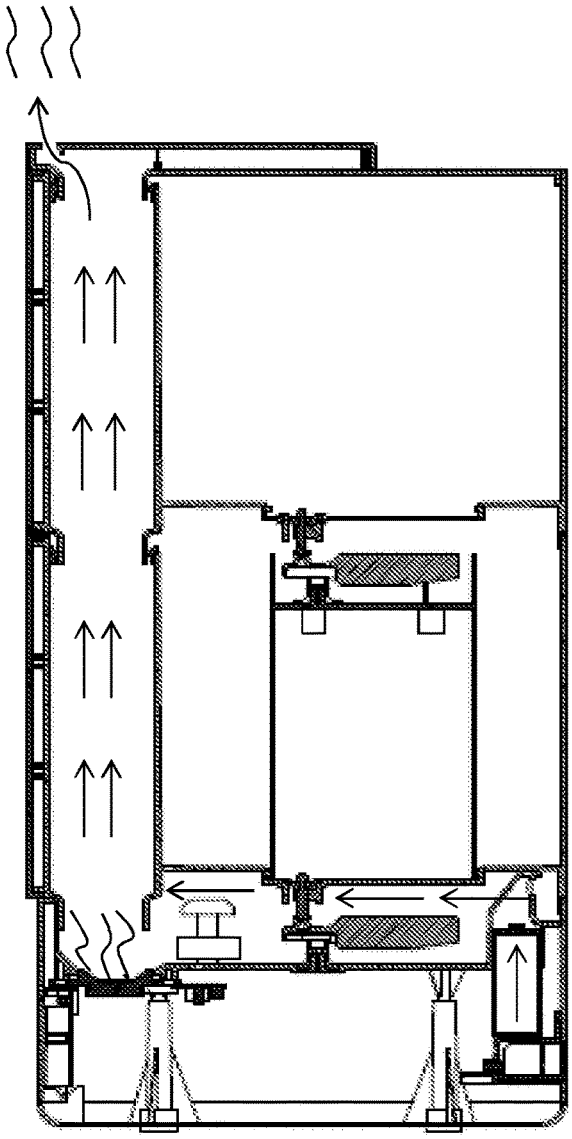
FIG. 8 is a cross-sectional perspective view of an ultrasonic humidifier with details showing the flow of the mist according to an embodiment of the present disclosure.

Now refer to FIG. 8, FIG. 8 illustrates the operation mechanism between the fan and the ultrasonic transducer plate as indicated by the arrows. The fan in the base on one side of the base chamber moves air across the base chamber and continue to reach the ultrasonic transducer plate on the other side of the base chamber to further carry the produced mist upward through the mist channel and push the mist upward to exit the humidifier.

Many alterations and modifications may be made by those having ordinary skill in the art without departing from the spirit and scope of the disclosure. Therefore, it must be understood that the illustrated embodiments have been set forth only for the purposes of examples and that they should not be taken as limiting the disclosure as defined by the following claims.

What is claimed is:

1. An ultrasonic humidifier comprising:

a base chamber having a first floater;

a water reservoir coupled to the base chamber having a second floater; and a top water tank disposed on top of the water reservoir;

wherein the second floater is positioned at an upper portion of the water reservoir coupled to the top water tank.

2. The ultrasonic humidifier of claim 1, further comprising a mist channel vertically disposed alongside the water reservoir and the top water tank, wherein the mist channel is extended from the base chamber.

3. The ultrasonic humidifier of claim 1, further comprising:

a first draining device disposed at a bottom surface of the water reservoir, wherein the first draining device is coupled to the first floater in the base chamber; and a second draining device disposed at a bottom surface of the top water tank, wherein the second draining device is coupled to the second floater in the water reservoir.

4. The ultrasonic humidifier of claim 1, wherein a pair of permeable brackets extends from the bottom surface of the water reservoir providing a platform to keep the second floater in position at the upper portion of the water reservoir.

5. The ultrasonic humidifier of claim 1, wherein when a water level in the water reservoir falls and fails to keep the second floater in a horizontal position, water in the top water tank replenishes the water reservoir via the second draining device.

6. The ultrasonic humidifier of claim 1, wherein the first floater in the base chamber vertically aligns with the second floater in the water reservoir.

7. An ultrasonic humidifier comprising:

a base chamber having a first floater;

a first reservoir coupled to the base chamber having a second floater;

a second reservoir coupled to the first reservoir having a third floater; and a top water tank disposed on top of the second reservoir.

8. The ultrasonic humidifier of claim 7, comprising a mist channel vertically disposed alongside the first reservoir, the second reservoir and the top water tank, wherein the mist channel is extended from the base chamber.

9. The ultrasonic humidifier of claim 7, wherein a fan is disposed on one side of the base chamber and an ultrasonic transducer plate is disposed on another side of the base chamber opposite to the fan.

10. The ultrasonic humidifier of claim 7, further comprising:

a first draining device disposed at a bottom surface of the first reservoir, wherein the first draining device is coupled to the first floater in the base chamber;

a second draining device disposed at a bottom surface of the second reservoir, wherein the second draining device is coupled to the second floater in the first reservoir; and a third draining device disposed at a bottom surface of the top water tank, wherein the third draining device is coupled to the third floater in the second reservoir.

11. The ultrasonic humidifier of claim 7, wherein the first reservoir and the second reservoir have identical dimensions.

12. The ultrasonic humidifier of claim 7, wherein a pre-determined water level is maintained in the base chamber, wherein the pre-determined water level is measured from an exposing surface of the ultrasonic transducer plate to a bottom rim of the first floater, the bottom rim of the first floater is the bottom surface of the first floater in contact with the surface of water in the base chamber, wherein the pre-determined water level is between 25 mm to 45 mm.

13. The ultrasonic humidifier of claim 12, wherein the pre-determined water level in the base chamber is approximately 35 mm.

14. An ultrasonic humidifier having stackable water reservoirs:

a base chamber;

a plurality of stackable water reservoirs coupled to the base chamber;

a top water tank;

wherein the plurality of stackable water reservoirs is vertically disposed between the base chamber and the top water tank.

15. The ultrasonic humidifier of claim 14, wherein each of the plurality of stackable water reservoirs has a floater and a draining device, wherein each draining device in the plurality of stackable water reservoirs vertically aligns with each other; wherein each floater in the plurality of stackable water reservoirs vertically aligns with a floater in the base chamber.

16. The ultrasonic humidifier of claim 14, further comprising a mist channel extends from the base chamber and is vertically disposed alongside the plurality of stackable water reservoirs and the top water tank.

17. The ultrasonic humidifier of claim 14, wherein the plurality of stackable water reservoirs has identical dimensions.

18. The ultrasonic humidifier of claim 14, wherein a capacity of the ultrasonic humidifier expands by adding additional units of the plurality of stackable water reservoirs; wherein the capacity of the ultrasonic humidifier reduces by removing at least one of the plurality of stackable water reservoirs.

19. The ultrasonic humidifier of claim 14, wherein the top water tank is coupled and directly disposed on top of an uppermost unit of the plurality of stackable water reservoirs.

20. The ultrasonic humidifier of claim 19, wherein the top water tank supplies water to the plurality of stackable water reservoirs, wherein the plurality of stackable water reservoirs supplies water to the base chamber.

* * * * *